US009810471B2

(12) United States Patent
Kang et al.

(10) Patent No.: US 9,810,471 B2
(45) Date of Patent: Nov. 7, 2017

(54) REFRIGERATOR

(71) Applicant: LG ELECTRONICS INC., Seoul (KR)

(72) Inventors: Sungsik Kang, Seoul (KR); Sinyoung Kang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 113 days.

(21) Appl. No.: 15/002,108

(22) Filed: Jan. 20, 2016

(65) Prior Publication Data

US 2016/0216021 A1 Jul. 28, 2016

(30) Foreign Application Priority Data

Jan. 22, 2015 (KR) ..... 10-2015-0010395

(51) Int. Cl.
*F25C 5/18* (2006.01)
*F25C 5/00* (2006.01)

(52) U.S. Cl.
CPC ..... *F25C 5/005* (2013.01); *F25C 2400/08* (2013.01); *F25C 2500/08* (2013.01)

(58) Field of Classification Search
CPC ..... F25C 5/005; F25C 2400/10
USPC ..... 62/341, 344, 381
See application file for complete search history.

(56) References Cited

U.S. PATENT DOCUMENTS 2,063,770 A * 12/1936 Taylor ..... F25C 1/142 62/346
2,559,414 A * 7/1951 Erickson ..... F25C 1/04 62/137
3,572,053 A * 3/1971 Jacobus ..... F25C 5/005 222/140
5,947,342 A * 9/1999 Song ..... F25C 5/005 222/146.6

FOREIGN PATENT DOCUMENTS

KR 10-2011-0039713 A 4/2011
KR 10-2013-0041700 A 4/2013

* cited by examiner

*Primary Examiner* — Melvin Jones
(74) *Attorney, Agent, or Firm* — KED & Associates, LLP

(57) ABSTRACT

A refrigerator may include an ice container, a discharge unit, which is provided at the ice container and has an outlet through which ice cubes are discharged, an ice discharging unit, which is provided in the ice container in a manner of rotatable in forward and reverse directions so as to selectively discharge ice cubes, which move thereinto by their own weight, in an uncrushed state or a crushed state, a first ice agglomeration blocking member, which is disposed over the ice discharging unit and is rotated by rotation of the ice discharging unit, and a second ice agglomeration blocking member, which is disposed over the ice discharging unit and is rotated by rotation of the first ice agglomeration blocking member, and which is coupled at a portion thereof to the first ice agglomeration blocking member and at another portion thereof to the ice container.

20 Claims, 14 Drawing Sheets

(a)

(b)

REFRIGERATOR

CROSS-REFERENCE TO RELATED APPLICATION

This application claims priority under 35 U.S.C. §119 to Korean Patent Application No. 10-2015-0010395, filed on Jan. 22, 2015, whose entire disclosure is hereby incorporated by reference.

BACKGROUND

1. Field

The present disclosure relates to a refrigerator, and more particularly to a refrigerator capable of preventing ice cubes contained in an ice container from agglomerating with each other.

2. Background

A refrigerator is a household appliance capable of objects in a refrigerated or frozen state using a refrigerant cycle consisting of compression, condensation, expansion and evaporation. A refrigerator includes, as main components, a body having a storage compartment defined therein, a door coupled to the body so as to open and close the body and an ice maker provided in the storage compartment or on the door.

The storage compartment or the door is provided with an ice container for containing ice cubes which are discharged from the ice maker. The ice container is connected to a dispenser for dispensing the ice cubes so as to allow the ice cubes to be discharged to the outside in response to user input. However, the ice cubes contained in the ice container agglomerate over time, thereby making it difficult to supply ice having a desired shape to the user.

BRIEF DESCRIPTION OF THE DRAWINGS

The embodiments will be described in detail with reference to the following drawings in which like reference numerals refer to like elements wherein.

DETAILED DESCRIPTION

Figure 1:
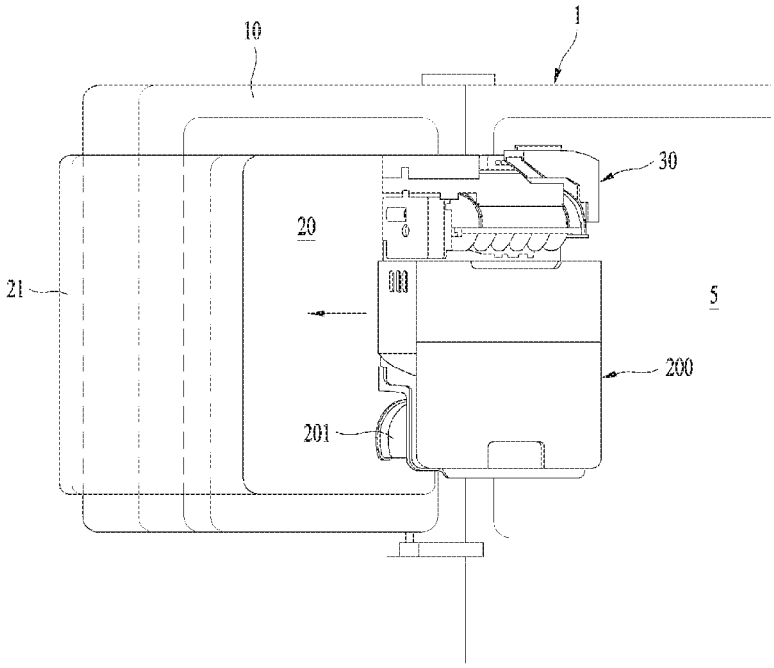
FIG. 1 is a view showing a refrigerator according to an embodiment of the present disclosure on which an ice container and an ice maker are mounted.

As shown in FIG. 1, the refrigerator according to an embodiment of the present disclosure includes a body 1 having a storage compartment 5, and a door 10 hingedly coupled to the body 1 so as to open and close the storage compartment 5. The door 10 is provided therein with an ice making compartment 20. The ice making compartment 20 is provided therein with an ice maker 30 and an ice container 200 for storing ice cubes, which are discharged from the ice maker 30.

The ice container 200 is provided at the rear part thereof with a driving motor 201 for driving an ice discharging unit 300 (see FIG. 2), which is contained in the ice container 200. The ice making compartment 20 is provided with an ice making compartment door 21 for selectively opening and closing the ice making compartment 20.

Figure 2:
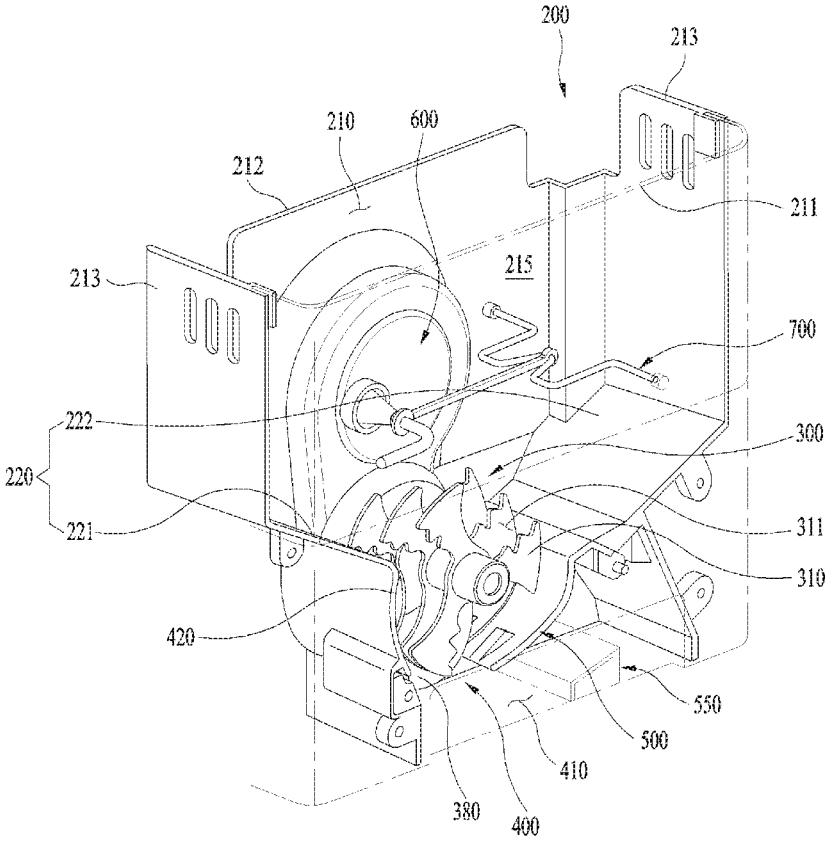
FIG. 2 is a perspective view of the ice container of the refrigerator according to the embodiment.

As shown in FIG. 2, the ice container 200 includes an opening part 210 provided on the upper face thereof, a front wall 211, a rear wall 212 and two lateral side walls 213. The two lateral side walls 213 include right and left walls, in which the right wall is the wall disposed at the right of the ice container 200 and the left wall is the wall disposed at the left of the ice container 200, based on FIG. 2. The front wall 211, the rear wall 212, the two lateral side walls 213 and the inclined guide surface 220 collectively define an ice storage space 215 in which ice cubes are stored. The ice container 200 is provided therein with an inclined guide surface 220 for supporting the ice cubes stored thereon and allowing the stored ice cubes to slide downward there along by their own weight.

The inclined guide surface 220 is divided into first and second inclined guide surfaces 221 and 222, which are spaced apart from each other and are positioned to be inclined downward and toward the center of the ice container 200.

Between the first inclined guide surface 221 and the second inclined guide surface 222, there is the ice discharging unit 300 for discharging ice cubes, stored in the ice container 200, to the outside. The first inclined guide surface 221 and the second inclined guide surface 222 are positioned at the left and right of the ice discharging unit 300.

In this embodiment, the ice discharging unit 300 is generally constituted by two or more rotating blades 310, between which a reception space 311 for accommodating ice cubes is provided. The ice cubes, which are placed on the first inclined guide surface 221 and the second inclined guide surface 222, move toward the ice discharging unit 300 due to gravity. The ice cubes, which have moved to the ice discharging unit 300, are discharged to the outside by the operation of the ice discharging unit 300.

Between the first inclined guide surface 221 and the second inclined guide surface 222, there are the ice discharging unit 300, which is rotatable, and a discharge unit or opening 400, which includes an outlet 410 through which ice cubes are ultimately discharged. The ice discharging unit 300 is installed at the discharge unit 400 in a manner of being rotatable in forward and reverse directions (or rotatable in opposite directions).

Stationary blades 380 are disposed under one side of the ice discharging unit 300, that is, at one side of the discharge unit 400 so as to crush ice cubes into chips of ice in cooperation with the rotating blades 310 of the ice discharging unit 300 when the ice discharging unit 300 rotates in a first direction. The stationary blades 380 may include at least two stationary blades such that the rotating blades 310 pass between the stationary blades 380.

Consequently, when the rotating blades 310 rotate while ice cubes are disposed between the stationary blades 380 and the rotating blades 310, ice cubes are pressed and crushed into chips of ice by the pressing force of the rotating blades 310.

An opening member or guide 500 is provided under the other side of the ice discharging unit 300, that is, the other side of the discharge unit 400, such that the outlet 410 selectively communicates with the ice storage space 215 so as to allow ice cubes in an uncrushed state to be discharged when the ice discharging unit 300 is rotated in the second direction, opposite to the first direction.

When the rotating blades 310 rotate while ice cubes are received in the reception spaces 311 provided in the rotating blades 310 of the ice discharging unit 300, the ice cubes press the opening member 500. The end of the opening member 500 is then rotated downward. At this time, the space between the opening member 500 and the rotating blade 310 is widened, and the uncrushed ice cubes are discharged to a dispenser through the outlet 410. An action-limiting member or a stopper 550 is provided under the opening member 500 to limit the operating range of the opening member 500 and to prevent an excessive amount of ice cubes from being discharged.

When the ice discharging unit 300 is rotated in the first direction (e.g., counterclockwise in FIG. 12), ice cubes are crushed into chips of ice by interference between the rotating blades 310 and the stationary blades 380, and the crushed ice is discharged to the outside. When the ice discharging unit 300 is rotated in the second direction (e.g., clockwise in FIG. 13), ice cubes, which are pressed by the rotating blades 310, press and open the opening member 500, and, the ice cubes in an uncrushed state are discharged.

A discharge guide wall 420 of the discharge unit 400 on which the stationary blades 380 are mounted is configured to have a shape corresponding to the rotational orbit of the rotating blades 310. The discharge guide wall is generally rounded so as to have a curvature corresponding to the rotational orbit of the rotating blades 310. The reason for this is to promptly discharge all of the crushed ice to the outside without leaving the crushed ice in the discharge unit 400.

A first ice agglomeration blocking (reduction) member 600, which is rotated together with the ice discharging unit 300, is provided over the ice discharging unit 300. The first ice agglomeration blocking member 600 is disposed over the ice discharging unit 300, and serves to agitate ice cubes positioned over the ice discharging unit 300 so as to prevent the ice cubes from agglomerating with each other.

A second ice agglomeration blocking (reduction) member 700 is provided over the ice discharging unit 300. The second ice agglomeration blocking member 700 is rotated by the rotation of the first ice agglomeration blocking member 600, and is coupled at one side thereof to the first ice agglomeration blocking member 600 and at the other side thereof to the ice container 200.

The second ice agglomeration blocking member 700 is disposed beside the first ice agglomeration blocking member 600 so as to release the agglomeration or accumulation of ice cubes that are disposed at a position at which it is difficult to release the agglomeration of ice cubes by the first ice agglomeration blocking member 600.

Figure 3:
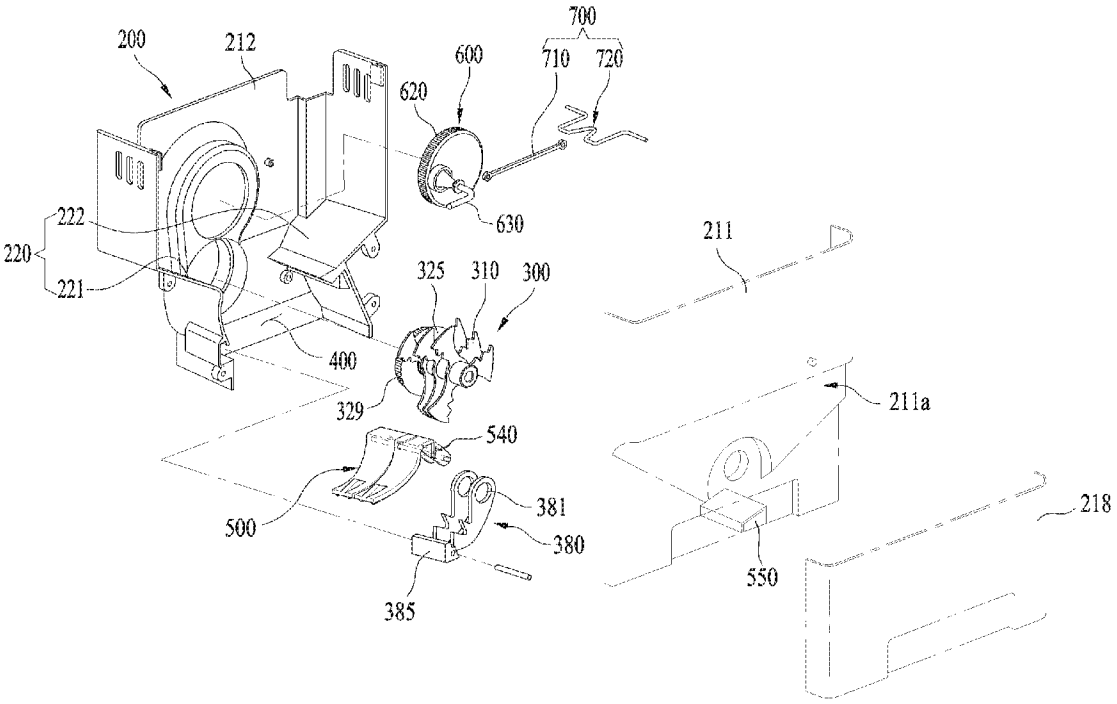
FIG. 3 is an exploded perspective view of the ice container of the refrigerator according to the embodiment.
Figure 4:
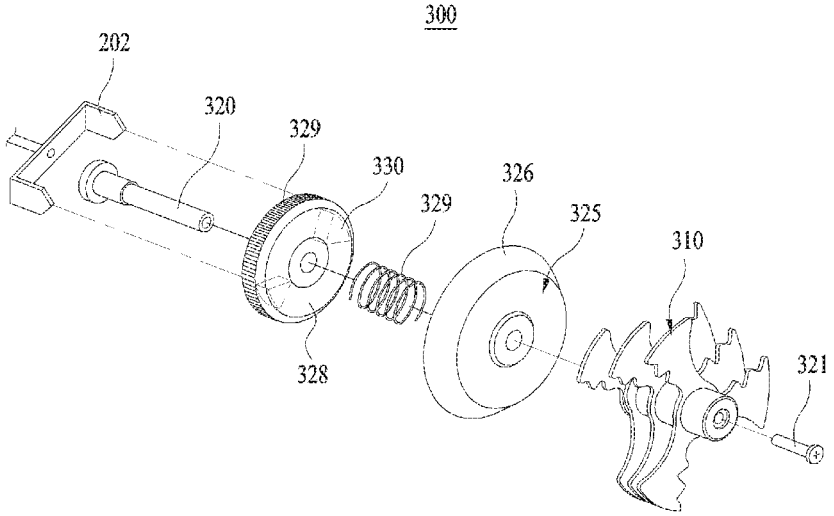
FIG. 4 is an exploded perspective view of an ice discharging unit of the refrigerator according to the embodiment.

As shown in FIGS. 3 and 4, the ice discharging unit 300 is constructed in such a manner that the plurality of rotating blades 310 are secured to a rotating shaft 320, and the rotating shaft 320 extends through a support plate 325 and a connecting plate 328 connected to the driving motor 201 (see FIG. 1). The rotating blades 310 are spaced apart from each other at predetermined intervals, and are secured to the rotating shaft 320 so as to be rotated together with the rotating shaft 320. The connecting plate or a gear 328 of the ice discharging unit 300 is provided on the outer circumferential surface thereof with teeth 329.

The stationary blades 380 also includes a plurality of stationary blades, and first ends of the stationary blades 380 are mounted on the rotating shaft 320. The first ends of the stationary blades 380 are provided with respective through holes 381 into which the rotating shaft 320 is inserted. The through holes 381 preferably have a larger diameter than the rotating shaft 320 such that the stationary blades 380 cannot be moved even by the rotation of the rotating shaft 320. The respective first ends of the stationary blades 380 are generally disposed between the rotating blades 310.

The second ends of the stationary blades 380 are secured to a wall of the discharge unit 400. The second ends of the stationary blades 380 are connected to a fixing member 385, and the fixing member 385 is fitted in the wall of the discharge unit 400, with the result that the stationary blades 380 are fixedly secured to the discharge unit 400.

As shown in FIG. 3, the opening member 500 generally includes one or more opening members 500, and is disposed beside the stationary blades 380. The opening member 500 is hingedly coupled to the discharge unit 400, and may be made of an elastic material or supported by an elastic element 540 (see FIG. 6) such as a spring. The elasticity enables the end of the opening member 500 to be returned to the normal position by the release of the pressing action by ice cubes after the opening member 500 is rotated downward by the pressing action of the ice cubes.

After the ice discharging unit 300, the stationary blades 380 and the opening member 500 are mounted on the ice container 200, a front plate 211*a* constituting the front wall of the ice container 200 is mounted on the ice container 200. A cover member 218 may be coupled to the lower part of the front surface of the front plate 211*a* such that the opening member 500 and the stationary blades 380 are not visible from the outside.

The first ice agglomeration blocking member 600, which is rotatable in the state of being engaged with the ice discharging unit 300, is mounted on the rear wall 212 of the ice discharging unit 300. A rotating plate or a gear 610 of the first ice agglomeration blocking member 600 is provided on the outer circumferential surface thereof with teeth 620. The teeth 329 of the connecting plate 328 engage with the teeth 620 of the rotating plate 610, whereby the rotational force of the ice discharging unit 300 is transmitted to the first ice agglomeration blocking member 600.

Since the ice discharging unit 300 and the first ice agglomeration blocking member 600 rotate in the state of being engaged with each other through the teeth 620 and 329, the rotational directions of the ice discharging unit 300 and the first ice agglomeration blocking member 600 are opposite to each other. For example, the first ice agglomeration blocking member 600 rotates counterclockwise when the ice discharging unit 300 rotates clockwise, and rotates clockwise when the ice discharging unit 300 rotates counterclockwise. Compare FIGS. 12 and 13.

The first ice agglomeration blocking member 600 includes a bar 630 protruding toward the inside of the ice container 200. See FIG. 14. The bar 630 is eccentrically positioned with respect to the rotational center of the first ice agglomeration blocking member 600 so as to rotate along a predetermined rotational orbit. Since the bar 630 is disposed at a position deviating from the rotational center of the rotating plate 610, the bar 630 rotates along a predetermined circular orbit during the rotation of the rotating plate 610.

The bar 630 may includes a first extension 634, extending in the anteroposterior direction of the ice container 200, and a second extension 632, extending from the first extension 634 at a predetermined angle. The first extension 634 and the second extension 632 may be configured to have an "L" shape overall. Accordingly, when the bar 630 rotates in the ice container 200, the first extension 634 and the second extension 632 are able to prevent ice cubes from agglomerating with each other in the ice container 200 due to the different shapes and movements thereof.

The second ice agglomeration blocking member 700 includes a first member (transfer link) 710, which is rotatably connected to the bar 630, and a second member (rotatable link) 720, which is coupled at a portion thereof to the first member 710 and is rotatably coupled at opposite ends thereof to the ice container 200. The first member 710 may be configured to have an elongated beam shape overall.

One end of the first member 710 is provided with a first through hole 712, into which the bar 630 is inserted. The bar 630 may be constituted by a single bent member. One end of the first extension 634 may be inserted into the first through hole 712, and the first member 710 may be coupled to the bar 630. The first through hole 712 has a larger sectional area than the first bar 630 such that the first member 710 is rotatably coupled to the bar 630.

The first member 710 may be provided at the other end thereof with a second through hole 714 into which the second member 720 (a third connector 750) is inserted. The second through hole 714 has a larger sectional area than the second member 720 such that the second member 720 is rotatably coupled to the first member 710.

The second member 720 may include a first connector 730 rotatably coupled to the ice container 200, a second connector 740, which extends from the first connector 730 at a predetermined angle, and the third connector 750, which is connected at opposite ends thereof to the second connector and at a portion thereof to the first member 710.

Since the first connector 730, the second connector 740 and the third connector 750 of the second member 720 are bent rather than being straight, the contact area thereof, capable of contacting ice cubes contained in the ice container 200, may be increased. Accordingly, the second member 720 is able to contact a large amount of ice cubes in order to release the agglomeration of ice cubes contained in the ice container 200.

The second member 720 may be symmetrically configured with respect to the center of the third connector 750. Since the second member 720 is symmetrically configured in the anteroposterior direction, it is possible to prevent the second member 720 from being warped due to force applied thereto during the rotation of the second member 720 in the ice container 200.

The second member 720 may include a coupling portion or a coupler 760 to be coupled to the first member 710. The coupling portion 760 may be inserted into the second through hole 760. The coupling portion 760 preferably has a width which is close to or greater than the thickness of the first member 710 such that the second member 720 is easily rotated with respect to the first member 710.

If the width of the coupling portion 760 is equal to the thickness of the first member 710, the first member 710 may be coupled to the second member 720 in an interference fit manner, thereby making it difficult to rotatably couple the first member 710 to the second member 720.

The first connector 730, the second connector 740 and the third connector 750 may be constituted by a single integral member. For example, the second member 720 may be constructed in such a way as to bend a single wire multiple times so as to realize the first connector 730, the second connector 740 and the third connector 750.

The third connector 750 may be connected between the coupling portion 760 and the second connector 740 at an acute angle less than 90 degrees. Since the second connector 740 extends further than the coupling portion 760 so as to be close to the first ice agglomeration blocking member 600 by virtue of the third connector 750, the contact area of the second member 720 that is capable of contacting the ice cubes contained in the ice container 200 may be increased. Accordingly, the effect of releasing the agglomeration of ice cubes by the second member 720 may be improved.

As shown in FIG. 4, the ice discharging unit 300 includes the plurality of rotating blades 310 secured to the rotating shaft 320, the support plate 325 and the connecting plate 328. An elastic element 329 such as a coil spring for elastically supporting the connecting plate 328 is disposed between the support plate 325 and the connecting plate 328.

By fitting an insert member 321 into the front end of the rotating shaft 320 in the state in which the rotating blade 310, the support plate 325, the connecting plate 328 and the elastic member 329 are coupled to the rotating shaft 320, it is possible to prevent the above components from being separated from the rotating shaft 320.

The rotating shaft of the driving motor 201 (see FIG. 1) is provided with a hook member 202 to which the connecting plate 328 is detachably coupled, and the connecting plate 328 is provided with a catch protrusion 330, on which the hook member 202 is caught. The support plate 325 is provided at the outer circumferential surface thereof with an inclined surface 326. The inclined surface 326 is intended to allow ice cubes positioned on the outer surface to be easily moved toward the rotating blade 310. The plurality of rotating blades 310 are spaced apart from each other, and the space between the rotating blades 310 is preferably smaller than the ice cubes.

When the driving motor 201 rotates, the hook member 202 rotates, and the connecting plate 328 in turn rotates. Consequently, the first ice agglomeration blocking member 600, which engages with the teeth 329 of the connecting plate 328, may be rotated.

Figure 5:
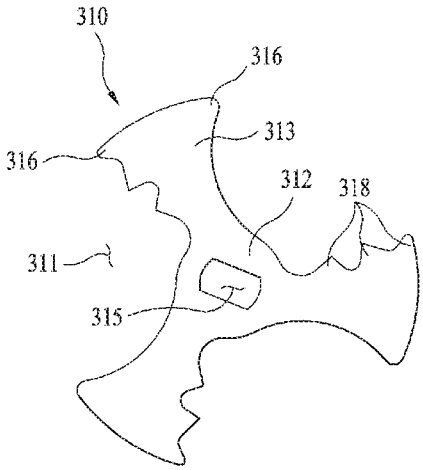
FIG. 5 is a front view of a rotating blade of the refrigerator according to the embodiment.

As shown in FIG. 5, each of the rotating blades 310 includes a center part or a center 312, through which the rotating shaft 320 extends, and extension parts (extensions) 313, which radially extend from the center part 312. The center part 312 is provided with an elongated through hole 315 through which the rotating shaft 320 extends so as to enable the rotational movement of the rotating shaft 320 to be transmitted to the rotating blade 310.

The extension parts 313 include a plurality of extension parts (extensions) which are spaced apart from each other and between which ice cubes are received. Each of the extension parts 313 is configured to be enlarged radially outward, and the end of the extension part 313 is provided at both sides thereof with catch protrusions 316 so as to prevent the ice cubes present in the reception space 311 from escaping therefrom or from being transferred to the adjacent reception space. When the rotating blades 310 rotate while ice cubes are received in the reception space 311, the ice cubes located at the ends of the extension parts 313, are caught by the catch protrusions 316 and are thus moved in the direction in which the rotating blades 310 rotate.

When the rotating blades 310 move in the state in which multiple ice cubes are positioned near the catch protrusions 316, the catch protrusions 316 agitate the plurality of ice cubes, thereby preventing the ice cubes from agglomerating into a single lump. The extension part 313 is provided at one side thereof with a serrated crush protrusion or blade 318, which interferes with the stationary blades 380 to thereby crush ice cubes.

The extension part 313 is provided at the other side thereof, that is, at the side opposite the crush protrusion 318, with a smooth surface so as to allow ice cubes in the uncrushed state to move. Accordingly, in one reception space, the crush protrusion 318 is positioned to face the smooth side of the extension part 313.

Figure 6:
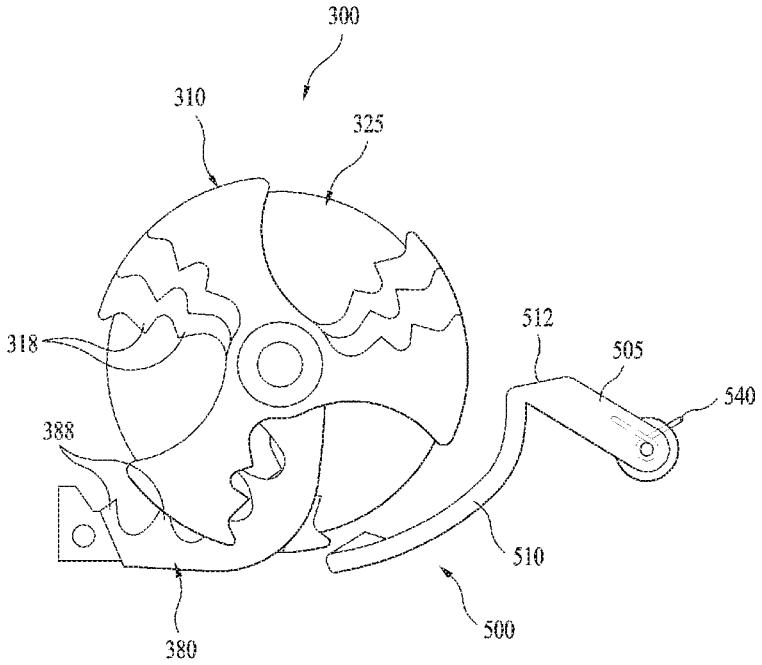
FIG. 6 is a front view of the ice discharging unit and a stationary blade of the refrigerator according to the embodiment.

As shown in FIG. 6, when the rotating blades 310 are secured to the rotating shaft 320, the rotating blades 310 are arranged such that a rear rotating blade 310 advances counterclockwise by a small angle with respect to the front rotating blade 310 rather than being arranged in a line therewith. In other words, the rotating blades 310 are not completely aligned with one another but are misaligned such that the rear rotating blade 310 is advance counterclockwise by a predetermined angle with respect to the front rotating blade 310 when viewed from the front.

The reason for this is because, when the rotating blades 310 rotate toward the stationary blades 380 in order to crush ice cubes in the state in which the rotating blades 310 are arranged to be aligned with one another, the pressing force applied to the ice cubes is distributed, thereby hindering the efficient crushing action of ice cubes.

However, in the case in which the rotating blades 310 are misaligned with one another, after an ice cube comes into contact with the crush protrusion 318 of the first rotating blade 310 and is crushed by the crush protrusion 318, the crushed ice cube comes into contact with the crush protrusion 318 of the second rotating blade 310, and then the crush protrusion 318 of the third rotating blade 310, at predetermined time intervals.

Accordingly, the rotational force of the ice discharging unit 300 is concentrated on the respective crush protrusions 318, thereby remarkably increasing the ability to crush ice cubes. Each of the stationary blades 380 be provided with a serrated crush protrusion 388. Although each of the stationary blades 380 may be configured to have an "L" shape, the present disclosure is not limited thereto.

The opening member 500 is positioned near the stationary blades 380. The opening member 500 includes a rotating part or a rotating arm 505, which is rotatably mounted on the ice container 200. The rotating part 505 is provided with an elastic member 540 such as a torsional spring for elastically supporting the opening member 500.

The elastic member 540, which may be a torsional spring, is secured at one end thereof to the ice container 200 and at the other end thereof to one side surface of the opening member 500 so as to elastically support the opening member 500. When the pressing force, which is applied to the opening member 500 by ice cubes, is released after the opening member 500 is moved due to the ice cubes, the opening member 500 is raised and returned to its normal position by means of the elastic member 540.

The opening member 500 includes a first guide surface 510, which is disposed near the rotational orbit of the rotating blades 310, and a second guide surface 512, which is connected to both the first guide surface 510 and the rotating part 505. The first guide surface 510 and the second guide surface 512 are obliquely disposed. In particular, the second guide surface 512 is characterized by being continuous with the second inclined guide surface 222 (see FIG. 2). The first guide surface 510 is generally rounded into a shape similar to the rotational orbit of the rotating blades 310 so as to guide the discharge of ice cubes.

Figure 7:
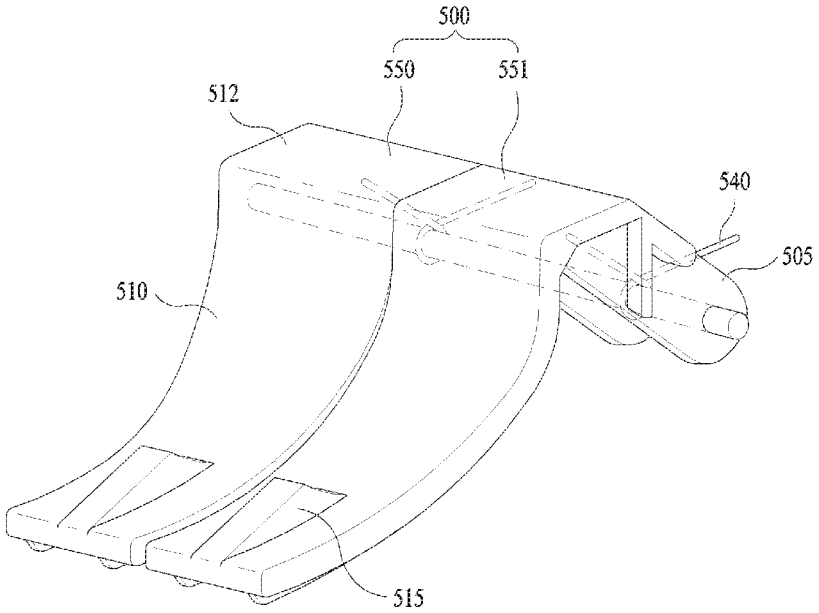
FIG. 7 is a perspective view of an opening member of the refrigerator according to the embodiment.

As shown in FIG. 7, the opening member 500 may includes a plurality of opening members or arms 550 and 551. The opening members 550 and 551 may be independently actuated and that the actuation of one opening member, e.g., 550, does not affect the actuation of another opening member, e.g., 551.

The reason why the plurality of opening members 550 and 551 are provided and the opening members 550 and 551 are independently actuated is as follows. In the case in which the opening member 500 is constituted by a single opening member, when ice cubes are located on only a portion of the first guide surface 510 and remain at that position without being discharged, there is the concern that other ice cubes may be discharged through the gap in which the ice cubes are not positioned.

According to this embodiment, even if ice cubes are located on one of the plurality of opening members 550 and 551 and one of the opening member remains in the opened state, other opening member, on which the ice cubes are not located, remain in the closed state, thereby preventing the other ice cubes from being undesirably discharged. Each of the plurality of opening members 550 and 551 is preferably provided with a separate elastic member 540.

The opening member 500 is provided with respective catch protrusions 515 so as to prevent ice cubes jammed between the opening members 500 and the rotating blades 310 from being discharged to the outside. The catch protrusions 515 are generally formed on the upper surface of the first guide surfaces 510 near the ends of the first guide surfaces 510.

Figure 8:
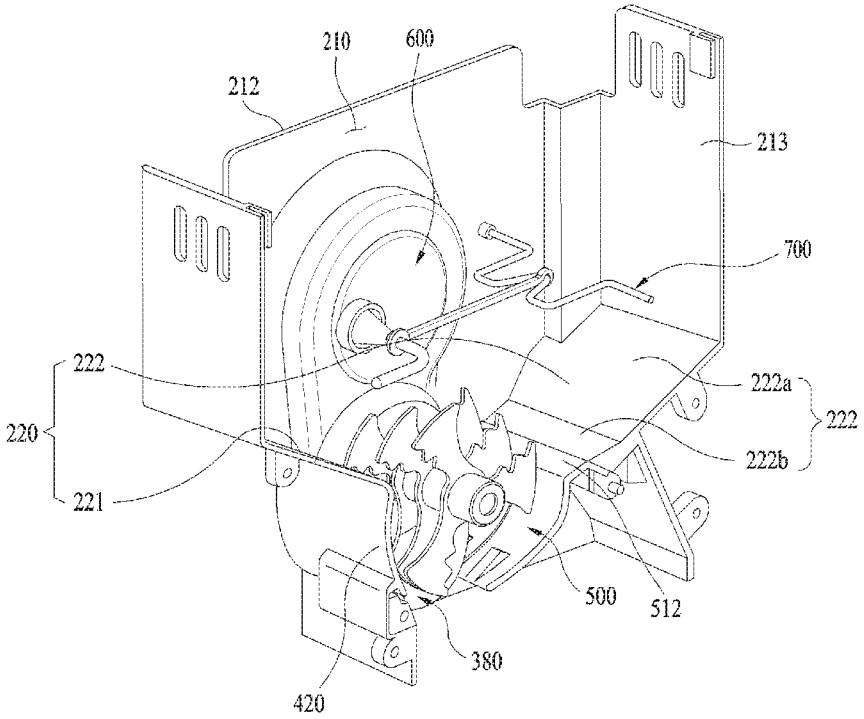
FIG. 8 is an internal perspective view of the ice container of the refrigerator according to the embodiment.

As shown in FIG. 8, the first inclined guide surface 221 is disposed close to the stationary blades 380, and the second inclined guide surface 222 is disposed close to the opening members 500 through which ice cubes are discharged. The discharge unit 400 is provided at a portion thereof with a discharge guide wall 420, which extends downward from the lower end of the first inclined guide surface 221.

The discharge guide wall 420 may be disposed over the region to which the ends of the stationary blades 380 are secured, and serves to guide the discharge of the crushed ice cubes so as to prevent the crushed ice cubes from remaining undischarged. The discharge guide wall 420 is generally rounded to be concave outward so as to have a predetermined curvature.

The second inclined guide surface 222 is sectioned into two parts. The reason for this is to control the speed at which ice cubes move to the ice discharging unit 300 along the second inclined guide surface 222 so as to prevent the ice cubes from breaking. The second inclined guide surface 222 includes an outer inclined guide surface **222*a* connected to the lateral side wall of the ice container 200, and an inner inclined guide surface 222*b*, which is connected to the outer inclined guide surface 222*a* and is disposed close to the ice discharging unit 300**.

The inner inclined guide surface 222*b* has a smaller angle of inclination than the outer inclined guide surface 222*a* such that the speed at which ice cubes move along the outer inclined guide surface 222*a* is decreased at the inner inclined guide surface 222*b*. The second guide surface 512 of the opening member 500 is disposed at the end of the inner inclined guide surface 222*b* so as to constitute the continuous surface with the inner inclined guide surface 222*b*.

When the opening member 500 closes the outlet 410, the second guide surface 512 and the inner inclined guide surface 222*b* constitute a continuous surface, thereby serving to decrease the speed at which ice cubes move. When the opening member 500 opens the outlet 410, the second guide surface 512 moves downward to guide ice cubes toward the outlet 410.

Figure 9:
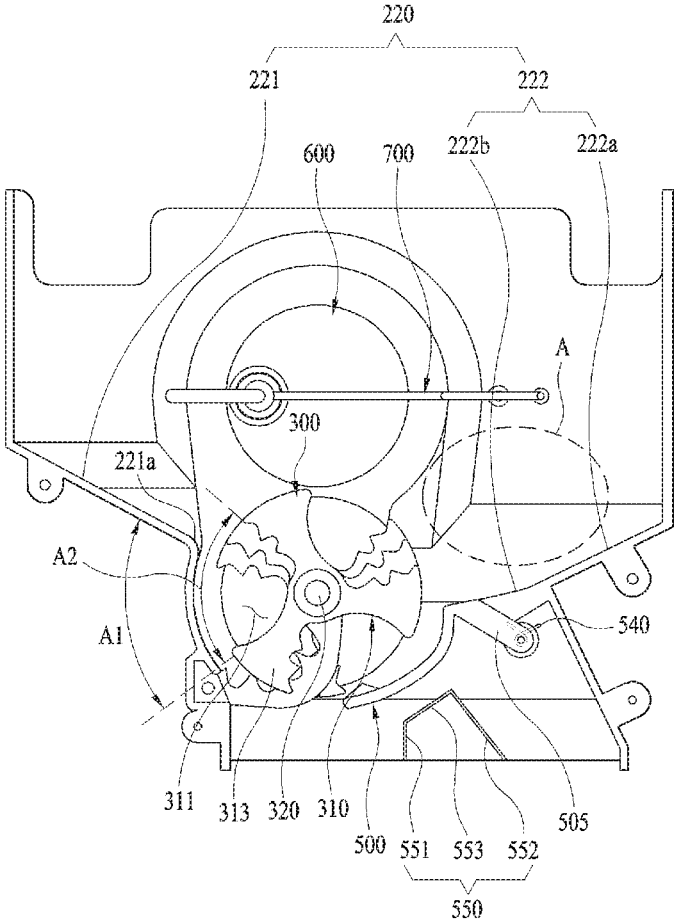
FIG. 9 is an internal front view of the ice container of the refrigerator according to the embodiment.

As shown in FIG. 9, the lower end of the first inclined guide surface 221 is positioned at a higher level than the rotating shaft 320 of the ice discharging unit 300. The reason for this is to prevent crushed ice, which is generated from ice cubes which are crushed at the location at which the stationary blades 380 are disposed, from being again raised to the first inclined guide surface 221.

The curvature of the discharge guide wall 420, which aims to prevent crushed ice cubes from remaining undischarged, may be set to be the same as the curvature of the rotational orbit of the rotating blades 310. The length A1 of the circular arc defined by the discharge guide wall 420 may be set to be equal to the distance between the adjacent extension parts 313, that is, the maximum width A2 of the reception space 311. Ice cubes, which are crushed in the reception space 311 and fly out of the reception space 311, collide with the discharge guide wall 420 and drop downward.

In order to maintain the ice cubes in the uncrushed state, the angle of inclination of the second inclined guide surface 222 may be set to be smaller than the angle of inclination of the first inclined guide surface 221. In order to cause the angle of inclination of the inner inclined guide surface 222*b* of the second inclined guide surface 222 to be substantially equal to the angle of inclination of the second guide surface 512 of the opening member 500 so as to constitute the continuous surface and in order to cause the angle of inclination of the second inclined guide surface 222 to be smaller than the angle of inclination of the first inclined guide surface 221, the height of the rotating part 505 of the opening member 500 is lower than the rotating shaft 320 of the ice discharging unit 300.

If the height of the rotating part 505 of the opening member 500 is higher than the rotating shaft 320 of the ice discharging unit 300, the second inclined guide surface 222 should be steeper, which is contrary to the intention to decrease the moving speed of ice cubes. Accordingly, from the point of view that the rotating part 505 of the opening member 500 has to be positioned lower than the second inclined guide surface 222, the height of the rotating part 505 of the opening member 500 should be lower than the rotating shaft 320 of the ice discharging unit 300.

If the open angle of the opening member 500 is excessively increased, an excessive amount of ice cubes is discharged, and there is thus a need to limit the open angle of the opening member 500. Actuation limiter or stop 550 is provided under the opening member 500 so as to limit the open angle of the opening member 500.

The actuation limiter 550 includes a first rib 551 extending vertically, a second rib 552 extending higher than the first rib 551, and a contact rib 553, which is obliquely connected between the upper end of the first rib 551 and the upper end of the second rib 552 and comes into contact with the opening member 500. The open angle of the opening member 500 is limited by contact between the opening member 500 and the contact rib 553.

The opening member 500 may include a plurality of opening members. In this case, the open angles of the opening members 500 may be set to be different from each other. The reason for this is because a specific rotating blade 310 is angularly displaced by a small angle with respect to the adjacent rotating blade 310, and a reception space 311 for a specific rotating blade 310 is also displaced at an angle relative to that of the adjacent rotating blade 310, when viewed from the front.

As shown in FIG. 9, the first ice agglomeration blocking member or component 600 and the second ice agglomeration blocking member or component 700 are disposed over the ice discharging unit 300. Since the second ice agglomeration blocking member 700 is positioned to be beside the first ice agglomeration blocking member 600, the first ice agglomeration blocking member 600 and the second ice agglomeration blocking member 700 are able to evenly release the agglomeration of ice cubes contained in the ice container 200.

The second ice agglomeration blocking member 700 may serve to prevent ice cubes in area A in the ice container 200 from agglomerating with each other. If the second ice agglomeration blocking member 700 is not provided, there is no component for releasing the agglomeration of ice cubes present in area A. Accordingly, when ice cubes agglomerate in area A, there is no other choice but to wait until the agglomerated ice cubes move downward or move to the area in which the first ice agglomeration blocking member 600 is disposed. However, this embodiment is able to prevent ice cubes from agglomerating with each other in any area of the ice container 200 by virtue of the provision of both the first ice agglomeration blocking member 600 and the second ice agglomeration blocking member 700.

Area A is positioned closer to the right wall than to the left wall of the ice container 200. The ice discharging unit 300 is disposed at the left of the ice container 200, which deviates from the center of the ice container 200, that is, is close to the left wall of the ice container 200 (see FIG. 13). Accordingly, the discharge of ice cubes present in area A by the ice discharging unit 300 may be relatively difficult, and the ice cubes present in area A are thus likely to strongly agglomerate with one another. In order to prevent such agglomeration, the second ice agglomeration blocking member 700 may release the agglomeration of ice cubes present in area A. The second ice agglomeration blocking member 700 is disposed to be closer to the right wall than to the left wall of the ice container 200 so as to prevent the agglomeration of ice cubes present in area A.

The ice discharging unit 300 is disposed closer to the left wall than to the right wall of the ice container 200, and the second ice agglomeration blocking member 700 is disposed closer to the right wall than to the left wall of the ice container 200. The strong agglomeration of ice cubes received in the ice container 200 is prevented, thereby making it possible to efficiently supply ice cubes to a user through the ice discharging unit 300.

Figure 10:
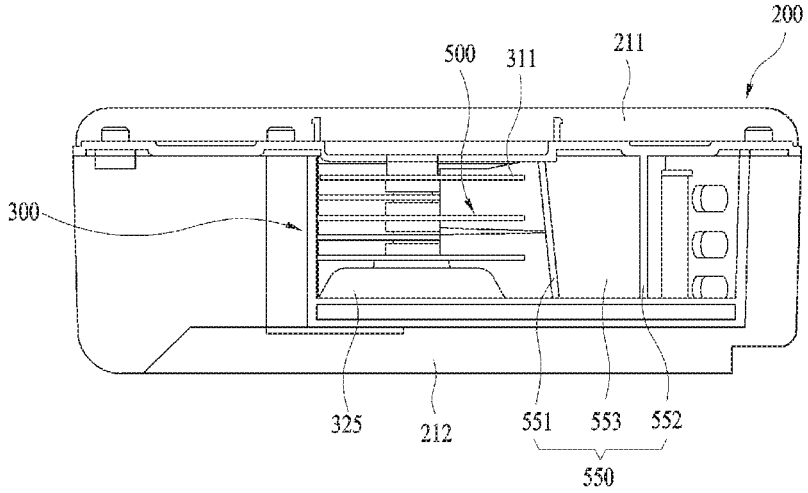
FIG. 10 is a bottom plan view of the ice container of the refrigerator according to the embodiment.

As shown in FIG. 10, it is possible to grasp the configuration of the bottom of the actuation limiter 550 by viewing the bottom of the ice container 200. In the drawing, the downward direction of the ice container 200 is actually the direction of the back surface of the ice container 200, and the upward direction of the ice container 200 is actually the direction of the front surface of the ice container 200.

The opening member 500 includes two opening members, which are independently operated. The first rib 551 is inclined toward the center of the ice container 200 as it goes toward the front surface from the rear surface of the ice container 200. The internal area of the ice container 200 through which ice cubes can pass is increased toward the back surface from the front surface of the ice container 200. Among the opening members 500 disposed in the ice container 200, the rotational angle of the front opening member 500 is set to be smaller than that of the rear opening member 500. The configuration of the first rib 551 is a reflection of the fact that the plurality of rotating blades 310 are not perfectly aligned with each other but are displaced at a slight angle with respect to each other.

Figure 11:
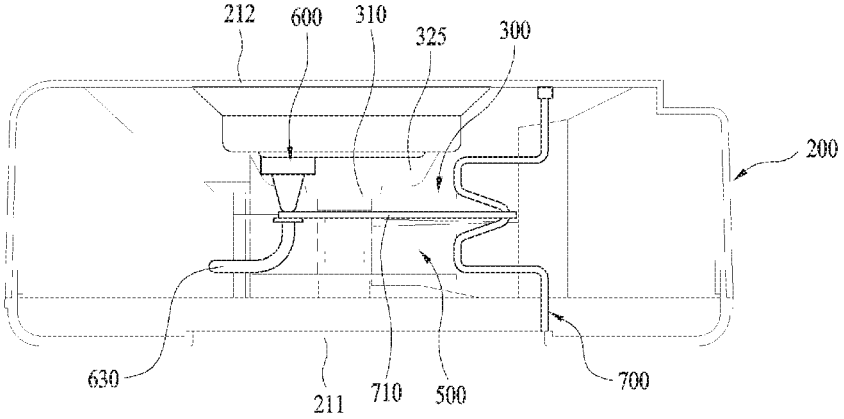
FIG. 11 is a top plan view of the ice container of the refrigerator according to the embodiment.

FIG. 11 is a plan view of the ice container 200. Since the size of the space between the rotating blade 210 and the front surface 211 of the ice container 200 is very small compared to the size of ice cubes, there is no concern that ice cubes will become jammed therebetween. However, since the size of crushed ice cubes may be close to the size of the space between the rotating blade 311 and the front surface 211 of the ice container 200, the crushed ice cubes may be jammed between the space, thereby hindering the rotational operation of rotating blades 310. Since the first ice agglomeration blocking member 600 and the second ice agglomeration blocking member 700 are distributed at the right and left of the ice container 200, it is possible to release the local agglomeration of ice cubes in the ice container 200.

Figure 12:
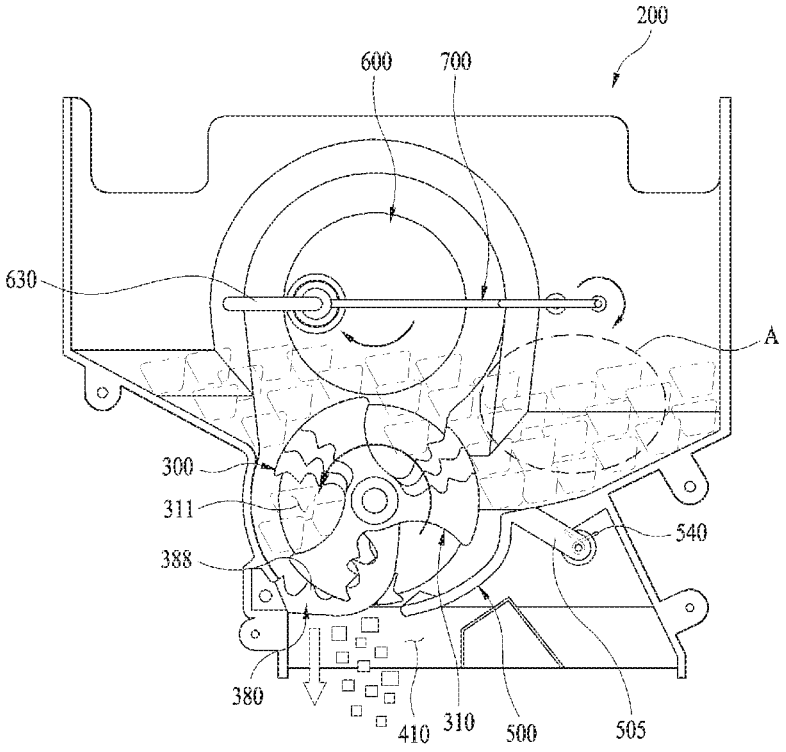
FIG. 12 is a front view of the ice container of the refrigerator according to the embodiment from which crushed ice is discharged.
Figure 14:
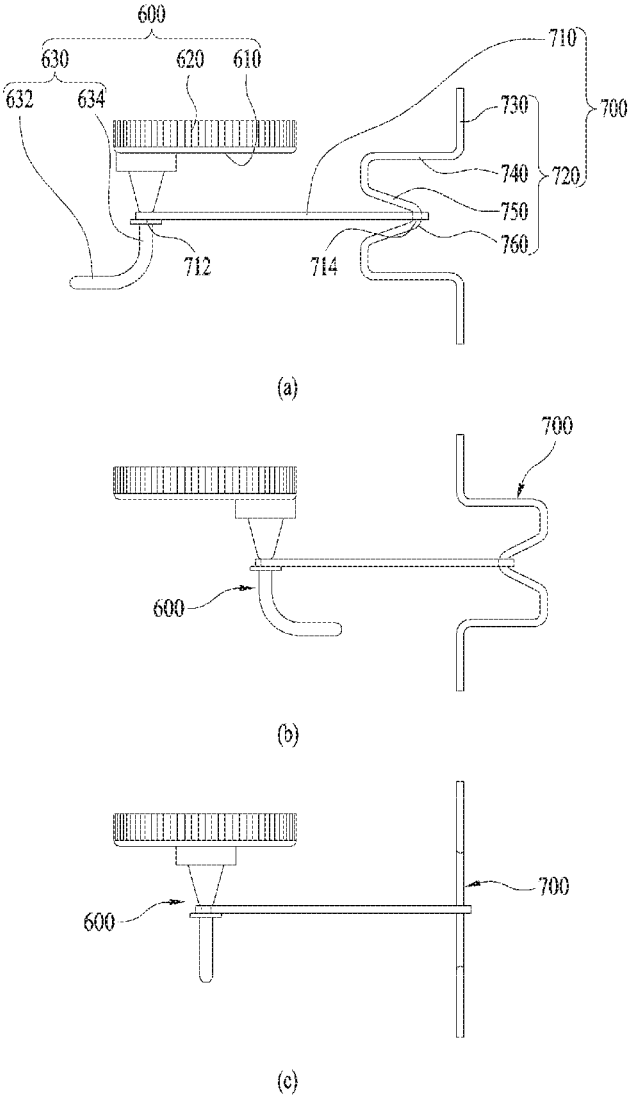
FIG. 14 is a view illustrating the operation of the second ice agglomeration blocking member.

Hereinafter, the operation of the present disclosure will be described with reference to the accompanying drawings. As shown in FIGS. 12 and 14, when a user intends to obtain crushed ice, the user inputs a command relating to the discharge of crushed ice in order to rotate the ice discharging unit 300 in the first direction. The crush protrusions 318 of the rotating blades 310 become gradually close to the crush protrusions 388 of the stationary blades 380.

Consequently, ice cubes, which are received in the reception spaces of the rotating blades 310, are placed on the stationary blades 380 by the rotation of the rotating blades 310. When the rotating blades 310 rotate further, the ice cubes clamped between the crush protrusions 318 of the rotating blade 310 and the crush protrusions 388 of the stationary blade 380 are crushed, and the crushed ice drops toward the outlet 410 for discharge to the outside. When discharging crushed ice, since the opening member 500 remains in the closed state, the discharge of uncrushed ice cubes downward is prevented.

At this time, the first ice agglomeration blocking member 600 and the second ice agglomeration blocking member 700 may release the agglomeration of ice cubes received in the ice container 200 while rotating in the clockwise direction, i.e. opposite to the first rotational direction. Accordingly, the crushed ice may be easily discharged through the ice discharging unit 300.

In particular, the second ice agglomeration blocking member 700 may contact ice cubes present in area A, and, in the case in which ice cubes present in area A are in the agglomerated state, may agitate the agglomerated ice cubes so as to release the agglomeration of the ice cubes.

Furthermore, since the bar 630 of the first ice agglomeration blocking member 600 is rotated along with the rotating plate 610, it is possible to release the agglomeration of ice cubes present in the area in which the first ice agglomeration blocking member 600 is positioned. In particular, since the second extension 632 is rotated about the first extension 634 while the bar 630 is rotated, the contact area between the first ice agglomeration blocking member 600 and the ice cubes received in the ice container 200 may be increased.

In the second ice agglomeration blocking member 700, the first member 710 is moved along with the bar 630 while the first ice agglomeration blocking member 600 is rotated. At this point, since the first connector 730 of the second member 720 is rotatably supported at one point by the ice container 200, the first connector 730 is not moved. The second ice agglomeration blocking member 700 may release the agglomeration of ice cubes received in the ice container 200 while rotating in the same direction as the first ice agglomeration blocking member 600.

When the ice discharging unit 300 rotates, the first ice agglomeration blocking member 600 may be rotated together with the second ice agglomeration blocking member 700. Since all of the first ice agglomeration blocking member 600, the second ice agglomeration blocking member 700 and the ice discharging unit 300 are rotated by the rotational force of the driving motor 301, they are all rotated together upon activation of the driving motor 210. The difference between them is that the first and second ice agglomeration blocking members 600 and 700 are rotated in the direction opposite to the rotational direction of the ice discharging unit 300.

When the first ice agglomeration blocking member 600 is rotated clockwise, the second ice agglomeration blocking member 700 may also be rotated clockwise with respect to the ice container 200.

For reference, FIG. 14 is a view illustrating the sequential operation of the second ice agglomeration blocking member 700 in accordance with the actuation of the first ice agglomeration blocking member 600.

Figure 13:
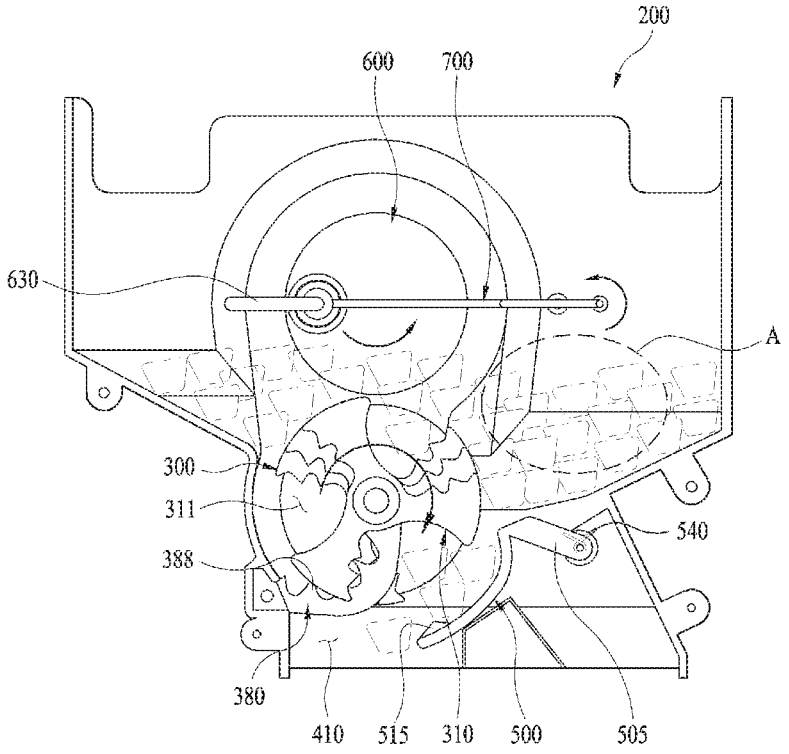
FIG. 13 is a front view of the ice container of the refrigerator according to the embodiment from which uncrushed ice is discharged.

As shown in FIGS. 13 and 14, when a user inputs a command relating to the discharge of ice cubes, the ice discharging unit 300 is rotated in the second direction. Accordingly, ice cubes received in the reception spaces 313 of the rotating blades 310 are moved toward the opening member 500 by the rotation of the rotating blades 310.

As the rotating blades 310 continue to rotate in the above state, the extensions 311 of the rotating blades 310 press the ice cubes located on the opening member 500. The pressing force of the rotating blades 310 is applied to the opening member 500 via the ice cubes.

Due to the pressing force of the ice cubes and the rotating blades 310, the opening member 500 is rotated downward, and a predetermined space is defined between the end of the extension 313 of the rotating blade 310 and the end of the opening member 500. As a result, ice cubes are discharged to the outside through the space. The open angle of the opening member 500 is not infinitely increased, but is limited by contact between the lower end of the opening member 500 and the actuation limiter 550, thereby preventing an excessive amount of ice cubes from being discharged.

When a predetermined amount of ice cubes is discharged, the rotation of the ice discharging unit 300 is halted, thereby releasing the application of the pressing force of the rotating blades 310 to the ice cubes. When the application of the pressing force is released, the opening member 500 is returned to its normal position again by the elastic force of the elastic member 540, at which the opening member 500 is positioned close to the ends of the extensions 313 of the rotating blades 301. Consequently, it is possible to prevent ice cubes from moving toward the outlet 410.

When ice cubes are positioned between the rotating blades 310 and the opening member 500, the ice cubes are caught by the catch protrusions formed on the opening member 500, thereby preventing the ice cubes from dropping toward the outlet 410. The ice discharging unit 300 shown in FIG. 13 is rotated in the direction opposite to the direction in which the ice discharging unit 300 shown in FIG. 12 is rotated. In this case, the first and second ice agglomeration blocking members 600 and 700 are also rotated in the direction opposite to the direction shown in FIG. 12.

Figure 15:
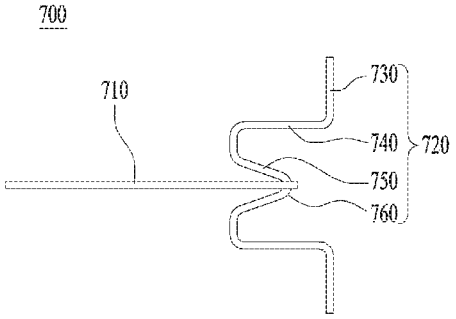
FIG. 15 is a view showing the second ice agglomeration blocking member according to another embodiment.
Figure 15:
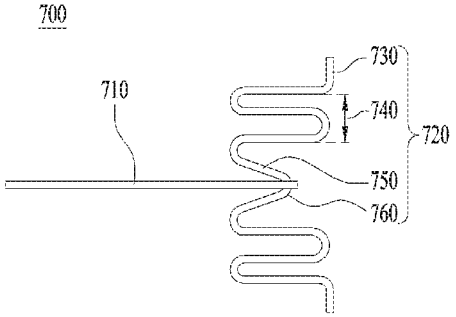

Referring to FIG. 15, the length of the coupling portion 760 may be greater than the width of the first member 710, as shown in FIG. 15*a*. According to the embodiment shown in FIG. 15*a*, the first member 710 may release the agglomeration of ice cubes in the state of having a high degree of freedom with respect to the movement of the second member 720.

As shown in FIG. 15*b*, the second member 720 may include a plurality of bent portions. The bent portions may be disposed in the second connector 740. According to this embodiment, since the contact area between the second member 720 and ice cubes is increased due to the bent portions, it is possible to more efficiently release the agglomeration of ice cubes contained in the ice container 200. The second ice agglomeration blocking member 700 may be constituted by a wire having a circular cross-section. The first member 710 and the second member 720 may be separately constituted by respective wires, and may be coupled to each other.

Since the wire has a circular cross-section, the wire can easily penetrate through the flat surface of the agglomerated ice cubes and thus release the agglomeration of the ice cubes. In other words, when the wire comes into contact with the agglomerated ice cubes along the contact line, the pressing force of the second ice agglomeration blocking member 700 is concentrated on the contact line, thereby easily releasing the agglomerated ice cubes.

If the second ice agglomeration blocking member 700 does not have a circular cross-section, like the wire, but has a cross-section having straight sides, the effect of releasing agglomerated ice is decreased. Furthermore, since the applied force for releasing the agglomeration of ice cubes is distributed, a higher load is applied to the second ice agglomeration blocking member 700, and an excessive load may thus be applied to the driving motor.

Since the agglomeration of ice cubes contained in the ice container is prevented, it is possible to prevent excessive load from being applied to a refrigerator due to the application of excessive force to the ice cubes upon discharging the ice cubes. Furthermore, since a single driving motor is used as the driving means in order to prevent ice cubes from agglomerating with each other, it is possible to simplify the configuration of the refrigerator.

Since the present disclosure is constructed such that ice cubes are discharged in an uncrushed state or in a crushed state if desired, user convenience is improved. Furthermore, since ice cubes move toward the outlet by their own weight without an additional transfer structure, the internal configuration is simplified.

The present disclosure teaches a refrigerator capable of preventing ice cubes contained in an ice container from agglomerating with each other.

The present disclosure also teaches a refrigerator in which the structure for preventing ice cubes from agglomerating with each other is simplified.

The present disclosure teaches a refrigerator, which is constructed such that ice cubes are discharged in an uncrushed state or in a crushed state depending on a user's selection so as to improve user convenience, and which enables ice cubes to move toward the outlet by their own weight without an additional transfer structure, thereby simplifying the internal configuration.

A refrigerator may include an ice container, a discharge unit, which is provided at the ice container and has an outlet through which ice cubes are discharged, an ice discharging unit, which is provided in the ice container such that is rotatable in forward and reverse directions so as to selectively discharge ice cubes, which move thereinto by their own weight, in an uncrushed state or a crushed state, a first ice agglomeration blocking member, which is disposed over the ice discharging unit and is rotated by the rotation of the ice discharging unit, and a second ice agglomeration blocking member, which is disposed over the ice discharging unit and is rotated by the rotation of the first ice agglomeration blocking member, and which is coupled at a portion thereof to the first ice agglomeration blocking member and at another portion thereof to the ice container.

When the ice discharging unit is rotated, the first and second ice agglomeration blocking members may be rotated simultaneously. The first and second ice agglomeration blocking members may be rotated in a direction opposite to the direction in which the ice discharging unit is rotated.

The ice discharging unit may include a driving motor for supplying rotational force, and the first and second ice agglomeration blocking members may be rotated by the driving motor.

The first ice agglomeration blocking member may include a bar extending toward the inside of the ice container, the bar being disposed at a position deviating from the rotational center of the first ice agglomeration blocking member so as to be rotated along a predetermined rotational orbit.

The bar may include a first extension extending in the anteroposterior direction of the ice container, and a second extension extending from the first extension at a predetermined angle. When the bar is rotated, the second extension may be rotated about the first extension.

The second ice agglomeration blocking member may include a first member rotatably connected to the bar, and a second member, which is coupled at a portion thereof to the first member and is rotatably coupled at another portion thereof to the ice container.

The second member may include a first connector rotatably coupled to the ice container, a second connector extending from the first connector at a predetermined angle, and the third connector, which is connected at a portion thereof to the second connector and at another portion thereof to the first member.

The second member may be symmetrically configured with respect to the center of the third connector. The second member may include a coupling portion connected to the first member, the coupling portion having a length which is close to or longer than the first member. The second member may include a plurality of bent portions.

The third connector may be connected between the coupling portion and the second connector at an acute angle smaller than 90 degrees.

The first connector, the second connector and the third connector may be integrally formed into a single member.

The first member may be provided at an end thereof with a first through hole into which the bar is inserted. The first member may be provided at the other end thereof with a second through hole into which the third connector is inserted.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

an ice container;

a discharge unit provided at the ice container and having an outlet to allow discharge of ice;

an ice discharging module provided in the ice container having at least one blade rotatable in forward and reverse directions to allow selective discharge of ice cubes in an uncrushed state or a crushed state;

a first ice agglomeration reduction member provided over the ice discharging module and rotated by rotation of the at least one gear; and a second ice agglomeration reduction member provided over the ice discharging module and is rotated by rotation of the first ice agglomeration reduction member, wherein one end of the second ice agglomeration reduction member is coupled to the first ice agglomeration reduction member and at least one other end of the second ice agglomeration reduction member is coupled to the ice container.

2. The refrigerator according to claim 1, wherein, the first and second ice agglomeration reduction members are concurrently rotated with the ice discharging module.

3. The refrigerator according to claim 2, wherein the first and second ice agglomeration reduction members are rotated in a direction opposite to a direction in which the ice discharging module is rotated.

4. The refrigerator according to claim 1, wherein the ice discharging unit includes a driving motor for supplying rotational force, and the first and second ice agglomeration reduction members are rotated by the driving motor.

5. The refrigerator according to claim 1, wherein the first ice agglomeration reduction member includes a bar extending toward an inside of the ice container, the bar being disposed at a position deviating from the rotational center of the first ice agglomeration reduction member so as to be rotated along a predetermined rotational orbit.

6. The refrigerator according to claim 5, wherein the bar includes a first extension extending in an anteroposterior direction of the ice container, and a second extension extending from the first extension at a predetermined angle.

7. The refrigerator according to claim 6, wherein, when the bar is rotated, the second extension is rotated about the first extension.

8. The refrigerator according to claim 5, wherein the second ice agglomeration reduction member includes a transfer link rotatably connected to the bar, and a rotatable link, which is coupled at a portion thereof to the transfer link and is rotatably coupled at another portion thereof to the ice container.

9. The refrigerator according to claim 8, wherein the rotatable link includes a first connector rotatably coupled to the ice container, a second connector extending from the first connector at a predetermined angle, and the third connector, which is connected at a portion thereof to the second connector and at another portion thereof to the transfer link.

10. The refrigerator according to claim 9, wherein the rotatable link is symmetrically configured with respect to the center of the third connector.

11. The refrigerator according to claim 10, wherein the rotatable link includes a coupling portion connected to the transfer link.

12. The refrigerator according to claim 11, wherein the third connector is connected between the coupling portion and the second connector at an acute angle less than 90 degrees.

13. The refrigerator according to claim 10, wherein the rotatable link includes a plurality of bent angles.

14. The refrigerator according to claim 10, wherein the first connector, the second connector and the third connector are integrally formed.

15. The refrigerator according to claim 10, wherein the transfer link is provided at an end with a first through hole into which the bar is inserted.

16. The refrigerator according to claim 10, wherein the transfer link is provided at the other end thereof with a second through hole into which the third connector is inserted.

17. The refrigerator according to claim 1, wherein the second ice agglomeration reduction member comprises a wire having a circular cross-section.

18. A refrigerator comprising:

an ice container including an opening provided at an upper face thereof, a front wall, a rear wall, and right and left side walls;

a discharge unit, provided at the ice container and having an outlet through which ice cubes are discharged;

an ice discharging module provided in the ice container having at least one blade rotatable in forward and reverse directions so as to selectively discharge ice cubes, in an uncrushed state or a crushed state;

a first ice agglomeration reduction member provided over the ice discharging module and rotated by rotation of the ice discharging module; and a second ice agglomeration reduction member provided over the ice discharging module, wherein at least one end of the second ice agglomeration reduction member is coupled to the first ice agglomeration reduction member so as to be rotated by rotation of the first ice agglomeration blocking member, and wherein the ice discharging module is positioned closer to the left side wall than to the right side wall of the ice container, and the second ice agglomeration reduction member is positioned closer to the right side wall than to the left side wall of ice container.

19. The refrigerator according to claim 18, wherein the first and second ice agglomeration reduction members are rotated in a direction opposite to a direction in which the at least one blade is rotated.

20. The refrigerator according to claim 19, wherein the second ice agglomeration reduction member includes a transfer link rotatably connected to the first ice agglomeration reduction member, and a rotatable link, which is coupled at a portion thereof to the transfer link and is rotatably coupled at another portion thereof to the ice container, wherein the rotatable link is positioned closer to the right side wall than to the left side wall.

* * * * *